US007788880B2

(12) United States Patent
Kern

(10) Patent No.: US 7,788,880 B2
(45) Date of Patent: Sep. 7, 2010

(54) DEVICE FOR INSERTING SHEETS INTO AN ENVELOPE

(75) Inventor: Peter Kern, Oberdiessbach (CH)

(73) Assignee: Kern Investment Consulting Management Ltd., St. Peter Port, Guernsey (GB)

( * ) Notice: Subject to any disclaimer, the term of this patent is extended or adjusted under 35 U.S.C. 154(b) by 339 days.

(21) Appl. No.: 10/553,969

(22) PCT Filed: May 12, 2003

(86) PCT No.: PCT/CH03/00302

§ 371 (c)(1),
(2), (4) Date: Jul. 28, 2006

(87) PCT Pub. No.: WO2004/098905

PCT Pub. Date: Nov. 18, 2004

(65) Prior Publication Data

US 2007/0040316 A1 Feb. 22, 2007

(51) Int. Cl.
*B65B 43/26* (2006.01)

(52) U.S. Cl. ..... 53/381.7; 53/569; 53/473

(58) Field of Classification Search ..... 53/381.7, 53/569, 259, 284.3, 381.5, 571, 473
See application file for complete search history.

(56) References Cited

U.S. PATENT DOCUMENTS

| | | | | | |
|---|---|---|---|---|---|
| 24,459 | A | * | 6/1859 | Kern | 200/51.12 |
| 2,915,863 | A | * | 12/1959 | Kummer | 53/117 |
| 3,253,384 | A | * | 5/1966 | Huck et al. | 53/53 |
| 3,568,401 | A | * | 3/1971 | Bonsch | 53/569 |
| 3,872,649 | A | * | 3/1975 | Wimmer | 53/569 |
| 4,649,691 | A | * | 3/1987 | Buckholz | 53/53 |
| 5,251,425 | A | * | 10/1993 | Kern | 53/460 |
| 5,327,705 | A | * | 7/1994 | DeFigueiredo | 53/569 |
| 5,487,254 | A | * | 1/1996 | Dronsfield | 53/381.7 |
| 5,675,959 | A | * | 10/1997 | Hamma et al. | 53/381.1 |
| 5,992,132 | A | * | 11/1999 | Auerbach | 53/569 |

FOREIGN PATENT DOCUMENTS

| | | | |
|---|---|---|---|
| EP | 0 504 114 | A | 9/1992 |
| EP | 1 297 970 | A | 4/2003 |
| JP | 07-047796 | A | 2/1995 |
| JP | 2001-077889 | A | 3/2001 |
| JP | 2001-121888 | A | 5/2001 |

* cited by examiner

*Primary Examiner*—Sameh H. Tawfik
(74) *Attorney, Agent, or Firm*—Birch, Stewart, Kolasch & Birch, LLP

(57) ABSTRACT

The invention relates to a device for inserting sheets into an envelope, comprising a holding device (11) for holding the envelope, transport means (15) for feeding the sheets to be inserted to the holding device (11), a feed device (7, 8, 9) for feeding the envelope to the holding device (11), along a feed direction, and a removal device (8, 22) for removing the filled envelope from the holding device (11), along a removal direction. The invention is characterized in that the feed device (7, 8, 9) and the removal device (8, 22) are disposed relative to the holding device (11) in such a manner that a first angle between the feed device and a main surface of the holding device (11) and a second angle between the removal direction and the main surface of the holding device (11) are predetermined in a fixed manner and are different from each other. The invention allows to simplify the construction of the device, thereby reducing its technical complexity and failure proneness. The elimination of a swiveling movement results in a gain in time, thereby increasing the capacity of the device.

17 Claims, 8 Drawing Sheets

DEVICE FOR INSERTING SHEETS INTO AN ENVELOPE

TECHNICAL FIELD

The invention relates to a device for inserting sheets into an envelope, comprising a holding device for the envelope, transport members for feeding the sheets to be inserted to the holding device, a feed device for feeding the envelope to the holding device, along a feed direction, and a removal device for removing the filled envelope from the holding device, along a removal direction. The invention furthermore relates to a method for inserting sheets into an envelope, to a device and a method for opening an envelope flap, and to a device and a method for the continuous feeding of stacks of envelopes.

PRIOR ART

In the case of mass dispatch of printed matter, such as, for example, brochures, advertising mail, invoices or bank statements, a large number of sheets have to be reliably inserted into envelopes in the shortest possible time. In this case, both the quantity and type of sheets which are to be inserted and therefore the thickness of a filled envelope and also the format of the envelope may vary between different dispatch tasks.

Devices for automatically inserting sheets into envelopes are already known from the prior art.

EP 0 504 114 B1 (Kern AG) shows a device, in which the flap of the envelope is opened by a rotating member and the envelope is fed along a feed direction of a packaging pocket by rotating members. In the process, a holding-down roller is lowered in order to somewhat open the envelope, and the packaging pocket is pivoted in the feed direction counter to the envelope, so that the envelope can be at least partially pulled onto the packaging pocket. The sheets to be inserted are then conveyed by transport elements into the packaging pocket and therefore into the envelope, and the packaging pocket is finally pivoted back in the removal direction, so that the envelope can be pulled off from the packaging pocket and conveyed on further.

The pivoting movements of the packaging pocket, which are necessary in order to move the pocket from the feed direction into the removal direction, require a certain amount of time and therefore slow down the process. Moreover, the pivotable pocket tends to "flutter" at high processing speeds, which makes its monitoring difficult and in turn limits the maximum speed and therefore the efficiency. Finally, it requires a complicated mechanical construction of the device.

SUMMARY OF THE INVENTION

It is the object of the invention, therefore, to provide a device which belongs to the technical field mentioned at the beginning and which permits increased capacity and has a simpler mechanical construction.

According to the invention, the feed device and the removal device are arranged relative to the holding device in such a manner that a first angle between the feed direction and a main surface of the holding device and a second angle between the removal direction and the main surface of the holding device are predetermined in a fixed manner and are different from each other.

Owing to the fact that the angles between the holding device and the feed direction and the removal direction are predetermined in a fixed manner, the construction of the device is simplified. This reduces the outlay on production and the susceptibility of the device to error. By eliminating a pivoting movement, time is gained, so that the capacity of the device is increased.

The removal device is advantageously arranged relative to the holding device in such a manner that the main surface of the holding device is permanently parallel to the removal direction. This has the result that the filled envelope, which is more sluggish due to its mass and less flexible due to its thickness than the empty envelope, can be transported away from the holding device in a straight direction. By contrast, the flexible, empty envelope is deflected from the feed direction in the direction of the holding device.

As an alternative, the holding device can be permanently aligned with the discharge point of the guide element. However, this requires a change in direction and, if appropriate, deformation of the filled envelope. In the case of thicker envelopes, this embodiment is less preferred.

The feed device preferably comprises a guide element with a discharge point, the guide element being convex at its discharge point. The empty envelope fed in follows the guide element, i.e. is conveyed along a convex path. The convexity of the guide element causes the empty envelope to be curved away from the feed direction in such a manner that that part which leaves the guide element at the discharge point is aligned with the holding device. The filled envelope which again leaves the holding device passes in a straight direction to the removal device and is not obstructed by the convex guide element because the latter is curved away from the straight direction.

As an alternative, a straight guide element with a separate bending element may also be provided, the bending element being formed, for example, by a rotating segment roll which engages in some sections in the conveying path of the envelope. The segment deflects that part of the envelope which leaves the guide element at its end in the direction of the holding device. The envelope is therefore likewise conveyed, during feeding, along a convex path which is determined by the guide element and the bending element. The segment roll or another bending element are designed and moved in such a manner that they do not obstruct the removal of the envelope from the holding device.

The guide element is advantageously formed by a curved guide plate with a vacuum device. The vacuum device generates a negative pressure between the guide plate and the envelope. This causes the envelope, which rests on the guide plate, to follow the curvature of the guide plate. At the discharge point, the front edge of the envelope, on account of the convex curvature, no longer points in the feed direction but rather is directed to the holding element.

Instead of a guide plate with a vacuum device, use may be made of a rotatable vacuum drum which connects the guide function and the feeding of the envelope. As an alternative, curved guide rails or other such guide elements may be provided which guide the envelope on both sides and bend it in such a manner that it is aligned with the holding element.

The holding element is preferably formed by a pocket onto which the envelope can be pulled. On the one hand, the pocket holds the pulled-on or clamped-on envelope and, on the other hand, suitable shaping of the pocket makes it possible for the front part and the rear part of the envelope to be held at a certain distance from each other, so that the sheets which are to be inserted can be introduced without obstruction and at high speed into the pulled-on envelope. The pocket can be formed in particular by two lateral profiled rails. A pocket for holding the envelope affords the advantage that no moving or intermittently actuated elements whatsoever are required in order to pull on the envelope, to hold it in an open position suitable for filling or in order to remove it again.

As an alternative, use may be made of holding devices which hold the envelope from the outside, for example lateral holding rails. The envelope can be held open by means of vacuum devices which are advantageously actuated intermittently in order not to adversely affect the feeding and removal of the envelope.

The removal device preferably comprises a first conveying device with a first, lower pressing roll and a second, upper pressing roll, the second pressing roll being pressed resiliently against the first pressing roll. Depending on the number and type of sheets inserted, the envelopes have different thicknesses after being filled. The spring-loaded, upper pressing roll permits both thin and also thick filled envelopes to be guided past without resetting being required. In addition, by means of the two opposite rolls, the envelope is securely guided during transport away from the holding device. A roll may also be formed by a plurality of spaced-apart rotational bodies, for example rollers.

As an alternative, the envelopes may also be conveyed by a removal device which acts merely from below on the envelopes, such as, for example, a conveyor belt or conveying rolls or rollers on one side. Finally, if the device is designed in a fixed manner for a certain envelope thickness, fixedly mounted rolls may be used.

If the removal device comprises two pressing rolls, the feed device is advantageously arranged below the removal device and comprises a second conveying device with an upper pressing roll and a lower pressing roll, the first pressing roll of the first conveying device at the same time forming the upper pressing roll of the second conveying device. This arrangement saves on structural elements, and the synchronization between feeding and removing the envelopes to and from the holding device is ensured and an extremely compact construction of the device is made possible.

As an alternative, the feeding can take place entirely separately from the removal, for example via a separate pair of rolls or rollers.

The device advantageously has a safeguard for the envelope, for preventing a premature removal of the envelope from the holding device. This ensures that the envelope is held on the holding device during the insertion of the sheets. A premature removal of the envelope may occur, for example, due to an increased frictional resistance between the inserted sheets and the envelope. This may lead to the elements for inserting the sheets conveying the envelope together with the (partially inserted) sheets away from the holding device in the removal direction. So that this can be prevented, the safeguard comprises, for example, a barrier which can be moved transversely with respect to the removal direction in front of the envelope held in the holding device and can thus be moved into the removal path.

Depending on the envelopes used, the material to be inserted and the design of the holding device and of the removal device, a safeguard of this type may be omitted.

The removal device preferably comprises a take-off roll with a segment for grasping the filled envelope which is to be removed. The segment engages in the removal plane only during part of the revolving period and is controlled in such a manner that it grasps the envelope when the latter has been completely filled. As a result, a reliable removal of the envelope from the pocket is achieved.

As an alternative, the filled envelope may also be removed by the holding device by the envelope, after the sheets are completely inserted, being conveyed further along the removal direction by elements for inserting the sheets, so that it is grasped by the removal device, for example a correspondingly positioned pair of rollers.

All of the transport devices for the envelopes are preferably driven by a single motor. The transmission of the movement to the individual driven elements, for example rolls or rollers, of the transport devices can take place, for example, by means of chains, toothed belts or gearwheels, with it being possible for the transmission ratios to be predetermined mechanically. This simplifies the controlling means, minimizes the consumption of material and further reduces the space needed by the device.

As an alternative, various driven elements or groups of elements can be coupled separately to motors, for example servomotors.

The feed device preferably has a segment roll for pulling the envelope off from a stack, with a rolling segment for fully pressing open a flap of the envelope, and a transport segment for transporting the envelope.

The segment roll may extend continuously over the entire width of the feed device, or it may be formed by a plurality of roll segments which are arranged along the width of the feed device. The rolling segment and the transport segment may be formed by corresponding sections of an individual component or by separate components. It is important that the outer surface of the roll or of the rollers acts only in segments on the envelope and has recesses along the remaining circumference. The envelope flap can be folded over without obstruction in these recesses, so that it is fully pressed open and rests flat, in a plane with the front side of the envelope.

As an alternative, the envelope may be pressed open by other means known from the prior art and transported by customary conveying means.

The segment roll is advantageously designed in such a manner that a first coefficient of friction of a surface of the rolling segment is smaller than a second coefficient of friction of a surface of the transport segment. By means of the lower coefficient of friction, the rolling segment slides over the surface of the envelope and fully presses open the envelope flap without transportation of the envelope taking place at the same time. The transport segment then leads, owing to its higher coefficient of friction, to a frictional connection with the envelope and conveys it along the feed direction. The rolling segment is therefore preferably arranged on the segment roll in such a manner that it comes into contact with the envelope or with the envelope flap upstream of the transport roll. The phase angle to be correspondingly selected is essentially determined by the height of the envelope flap.

As an alternative, instead of the coefficients of friction, the pressure which the rolling segment exerts on the envelope or on the flap thereof can be selected to be smaller than the pressure with which the transport segment acts on the envelope, so that a frictional connection only with the transport segment is produced.

The rolling segment and the transport segment are preferably formed by claws which are arranged on a common rotational axle. Each of these claws is formed by an extension arm and a circular segment fitted thereto. In this case, separate claws can be provided for the rolling segment and for the transport segment; however, it is also possible to use combined claws which do not bring about any frictional connection with the envelope in a front region, so that the envelope flap can firstly be completely opened. In a rear region, a frictional connection with the envelope is produced—for example owing to a different surface material—so that it is transported. In order to improve the concentricity of the segment roll, counterweights are advantageously additionally arranged on the axle.

A device for opening an envelope flap, which device is suitable, for example, for use with the device given above, comprises a blowing unit, the blowing unit being arranged in such a manner that it can blow a focused volumetric flow of air under the envelope flap. The volumetric flow presses open the envelope flap irrespective of its shape, size and position. Adaptations as are required in the case of purely mechanical devices are therefore unnecessary. In addition, an envelope which is partially glued together, for example due to storage with high air humidity, can also still be opened by the air flow. The blowing unit may be combined with mechanical elements, for example a segment roll as described above, which bring about a complete opening of the envelope flap.

The blowing unit preferably comprises a nozzle with a nozzle duct, the nozzle duct having a long-drawn-out shape with a length which corresponds essentially to the maximum length of the envelope flap, and the nozzle duct being arranged essentially parallel to the envelope flap. As a result, the volumetric flow is distributed over the entire length of the envelope to be opened. The nozzle duct may comprise an individual nozzle or a series of adjacent individual nozzles. The nozzle duct is aligned with the position of the envelope in such a manner that the airflow can reach under the flap even if the latter rests flat on the rear side of the envelope. Generally, the main direction of the volumetric flow will enclose an acute angle with the rear side of the envelope.

As an alternative, a plurality of nozzles can be arranged spaced apart along the width of the feed device.

A device for the continuous feeding of stacks of envelopes, which device can be arranged, for example, at the input of the above-described device for inserting sheets into an envelope, can lift the stacks of envelopes in a stacking region along a straight path. It comprises a first lift, which can be displaced along a section of the straight path, and a second lift, which can be displaced along the section of the straight path. In this case, both lifts can be displaced independently of each other along an entire length of the section of the straight path. The second lift can be completely moved away from the stacking region.

The section of the straight path along which both lifts can be displaced independently of each other is adjoined by a device for further processing the stack of envelopes or envelopes, for example the feed device of the device illustrated above for filling envelopes. By means of the independent displaceability of the two lifts and owing to the fact that the second lift can be moved completely away from the stacking region, it is made possible for the stack of envelopes to be able to be fed automatically without feeding gaps arising. The changing from one stack of envelopes to the next therefore does not result in an interruption of the filling operation, which increases the capacity of the filling device.

The first lift and the second lift are advantageously designed in such a manner that they can extend in a comb-like manner through each other. Each of the lifts comprises a plurality of fingers or prongs, with the fingers of a respective lift moving jointly in a plane. If both lifts are moved in the same plane, fingers of the first and of the second lift alternate. The comb-like arrangement permits a uniform supporting of the stack of envelopes to be lifted, irrespective of whether the first lift, the second lift or both lifts are used together for this. As a rule, one of the lifts will engage with its fingers from the one side in the stacking region while the fingers of the other lift are articulated from the opposite side.

As an alternative, the two lifts can in each case comprise an L-shaped element, the two L-shaped elements together covering a surface which corresponds essentially to the cross section of the stacking region for the maximum size of envelope which is to be processed.

The second lift is preferably mounted in a manner such that it can move along an essentially oval path. As a result, it can be moved out of the stacking region.

Furthermore, the lift can be moved continuously out of the region, back to an engagement position and further in the conveying direction until it moves out again.

As an alternative, the second lift may be mounted, for example, on a retractable or moveable rail.

In the case of a method for inserting sheets into an envelope, for example with a device for inserting sheets into envelopes as described above, the following steps are carried out:

a) feeding the envelope along a feed direction;
b) bending a front part of the envelope, so that the front part is aligned with a holding device;
c) pulling the envelope onto the holding device, the envelope returning elastically into an original, flat form;
d) inserting the sheets into the envelope;
e) removing the filled envelope from the holding device, along a removal direction parallel to a main surface of the holding device.

In the case of a method for opening an envelope flap, for example with a device for opening an envelope flap as described above, a focused volumetric flow of air is blown under the envelope flap.

In the case of a method for the continuous feeding of stacks of envelopes, the following steps are carried out, for example with a device for the continuous feeding of stacks of envelopes as illustrated above:

a) receiving a first stack of envelopes by a first lift in a receiving position,
b) lifting the first stack of envelopes by the first lift,
c) taking over the first stack of envelopes by a second lift in a transfer position,
d) moving of the first lift back into the receiving position,
e) receiving a second stack of envelopes by the first lift,
f) lifting the second stack of envelopes by the first lift,
g) moving the second lift into the transfer position,
h) taking over the second stack of envelopes by the second lift.

The method can be carried out cyclically without gaps between successive stacks occurring in the feeding.

From the following description of details and the entirety of the patent claims, further advantageous embodiments and combinations of features of the invention emerge.

BRIEF DESCRIPTION OF THE DRAWINGS

In the drawings used for explaining the exemplary embodiment.

In principle, identical parts are provided with the same reference numbers in the figures.

Ways of Implementing the Invention

Figure 1:
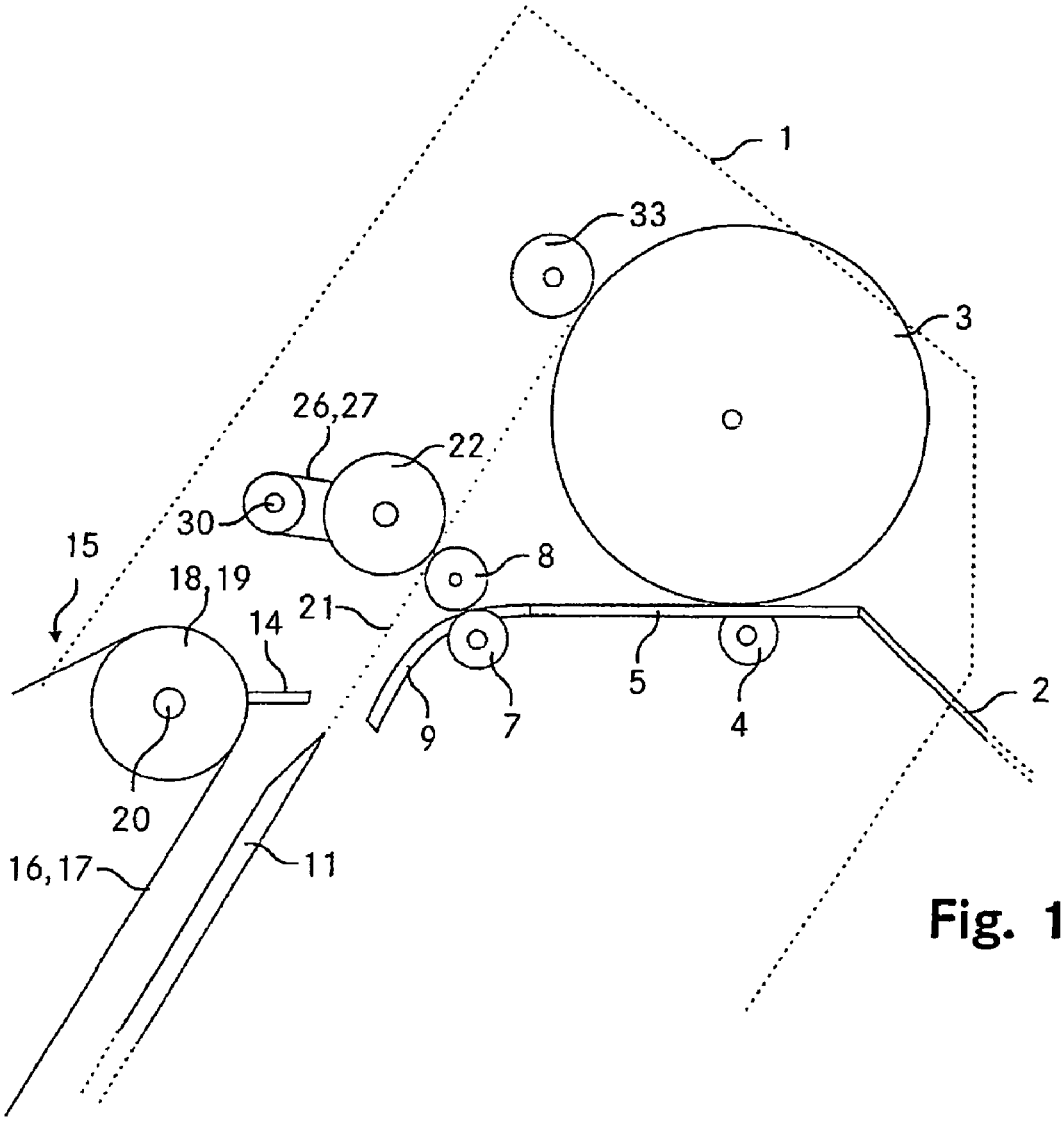
FIG. 1 shows a diagrammatic illustration of a device according to the invention for inserting sheets into an envelope, in side view.
Figure 2:
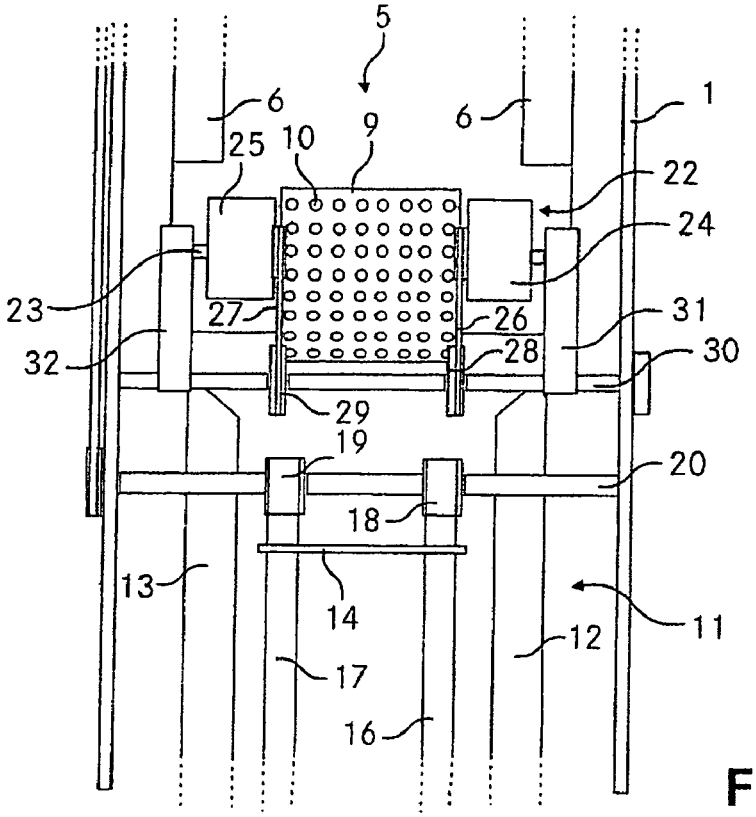
FIG. 2 shows a diagrammatic illustration of the device, as seen from above.

FIG. 1 shows a diagrammatic illustration of a device according to the invention for inserting sheets into an envelope, in side view. FIG. 2 shows the insertion region of the device, as seen from above. The contour of the housing 1 of the device is illustrated with dashed lines in FIG. 1 for orientation purposes. The side panels of the housing 1 contain in particular the bearings for mounting the axles for the rolls and rollers of the device and support guide elements. The envelopes which are to be filled are brought up in a stackwise manner on a ramp 2, in particular by a device for continuous feeding, as described further below. The ramp 2 has an inclination of approx. 45° and the stacks of envelopes are arranged on the ramp 2 in such a manner that that edge of the envelopes that is formed by the (closed) envelope flap rests on the oblique side. In this case, the envelope flap points toward the device. The inclination ensures, firstly, that the stacks of envelopes are supported by the oblique plane and cannot tip over, as may happen in the case of vertical feeding. Secondly, the force of gravity prevents the stacks from collapsing, as happens in the case of horizontal feeding.

At the upper end of the ramp 2, the envelope flap of the uppermost envelope is opened by an opening device (not illustrated here), for example by the blowing unit shown further below. The uppermost envelope with the envelope flap opened is then taken over by the segment roll 3. This is illustrated in detail further below. To transport the envelope, a mating roll 4 interacts with the segment roll 3 below a horizontal guide plane 5. For this purpose, in this region the guide plane 5 has a recess through which the mating roll 4 can pass. The segment roll 3 and the mating roll 4 act on the envelope on both sides with the same speed and transport it in this manner along the guide plane 5. The guide plane 5 is formed by a base plate and on both sides has guide plates 6 under which the envelope is guided.

The length of the guide plane 5 is shorter than the lowest height of the envelopes to be processed, with the result that the envelopes are taken over at the end of the guide plane 5 by a pair of rolls having a lower roll 7 and an upper roll 8. In the process, the envelope is briefly conveyed both by the pair of rolls 7, 8 and by the segment roll 3 and the mating roll 4.

The two rolls 7, 8 are in turn driven in such a manner that they act on the envelope on both sides with the same speed, which corresponds to the speed of the segment roll 3. As a result, the envelope is transported flat along the guide plane 5.

A guide plate 9 adjoins the end of the guide plane 5. Said guide plate is curved away downward and therefore forms a convex path for the envelopes brought up. So that the envelopes follow the guide plate 9, it is provided with a vacuum device. The latter, with a plurality of openings 10, which are arranged along the entire surface of the guide plate 9, generates a negative pressure, so that the envelope is sucked up. The front edge of the envelope, which is curved by the guide plate 9 and the vacuum device, leaves the guide plate 9 at a discharge point. The location of the discharge point is determined by the shape of the guide plate 9, the arrangement of the openings 10 and the prevailing negative pressure. It is selected in such a manner that the front edge of the envelope is aligned with a pocket 11, the pocket 11 being formed by two lateral profiles 12, 13. If envelopes of different composition are to be processed in the same device, the location of the discharge point can be changed without structural changes, for example merely by adapting the negative pressure or the suction power of the vacuum device.

The envelope is aligned with the pocket 11 in such a manner that, upon further transport, the lower side of the envelope is guided with the opened envelope flap under the profiles 12, 13. By means of the shape of the profiles 12, 13, tapering to a point, and by means of the curvature of the envelope along the guide plate 9, a distance is created between the front side and the rear side of the envelope, so that the envelope can easily be pulled onto the pocket 11 or the profiles 12, 13. The pulling-on takes place here by means of the pair of rolls 7, 8 which push the envelope onto the pocket 11. The profiles 12, 13 have a U-shaped cross section, with the open side pointing inward into the pocket space. The profiles 12, 13 therefore form a respective groove on their inner side. The pulling-on is completed when the envelope no longer has any contact with the pair of rolls 7, 8 and the guide plate 9. By virtue of its elasticity and by virtue of the shape of the profiles 12, 13, the envelope returns at this point into its original, flat shape and therefore now lies in the plane which corresponds to the main surface of the pocket 11.

Transport fingers 14 of a conveying device 15 engage in the pocket space between the lateral profiles 12, 13. This conveying device 15 is formed by two bands 16, 17 which, in the case of the insertion device, are guided over rollers 18, 19. The rollers 18, 19 are mounted on an axle 20 which is arranged above the pocket 11 in such a manner that the lower part of the bands 16, 17 runs parallel to the pocket. The fingers 14 are designed as cross-bars which are fastened vertically to the bands 16, 17. They convey the sheets which are to be inserted into the envelope clamped on the pocket 11. The sheets are guided here in the plane of the pocket, in the grooves of the profiles 12, 13, counter to the feed direction of the envelopes.

As soon as the inserted sheets are completely accommodated in the envelope, the fingers 14 act on the filled envelope via the sheets, so that said envelope is pushed upward from the pocket 11 along the profiles 12, 13. Since the envelope has its original, flat shape again and is additionally stabilized by the inserted sheets, it moves further along the plane 21 formed by the main surface of the pocket 11. The envelope no longer passes onto the guide plate 9, which is arranged below this plane 21, but rather is grasped by a pair of rolls formed by an upper roll 22 and the roll 8. The roll 8 therefore serves, firstly in interaction with the roll 7, for conveying the empty envelopes to the pocket 11 and, secondly, in interaction with the roll 22, for conveying away the filled envelopes. As a result, a more compact arrangement of the device is produced and the synchronization of feeding and removal is ensured.

The upper roll 22 is mounted on an axle 23. It is formed by two rollers 24, 25 and is driven by drive rollers 28, 29 by means of belts 26, 27. The drive rollers 28, 29 rotate by means of an axle 30 which is mounted in the housing 1. The axle 23 of the upper roll 22 is held rotatably between two extension arms 31, 32, the extension arms 31, 32 being fitted on the axle 30 of the drive rollers 28, 29 and being spring-loaded, so that the upper roll 22 is vertically moveable with respect to the roll 8, with it being necessary for the spring force to be overcome in order to press the rolls 22, 8 apart. This spring-loaded arrangement enables envelopes which have been differently filled to be transported away without adaptations to the device being necessary.

The rolls 22, 8 grasp the envelope and convey it, essentially further in a straight direction, along the plane 21, in the direction of the upper edge of the segment roll 3. The filled envelope therefore does not undergo any deformation during the further transport. A further roll 33 interacts with the upper side of the segment roll 3, so that the envelope can be removed between these rolls 3, 33. At the output of this pair of rolls 3, 33, it is taken over by a take-away device of known type (not illustrated), for example a conveyor belt, and transported further, for example to a device for glueing up the envelopes.

The conveying movement along the conveying plane between the segment roll and the curved guide plate can be assisted by a vacuum system, instead of by the long, lateral guide plates, said vacuum system generating a negative pressure for the conveyed envelope through openings in the conveying plane and, as a result, causing the envelope to move flat along the conveying plane.

Instead of a curved guide plate for feeding the envelopes to the pocket, a rotatable vacuum drum may be used. As a result, the envelopes are both curved and therefore deflected in the direction of the pocket and also transported further at the same time. The pair of rolls at the input of the guide plate can therefore be omitted. It is also possible for a vacuum belt designed in accordance with the desired convex curvature of the envelope to replace the convex guide plate.

Finally, all of the conveying movements or individual conveying movements of the envelopes and of the sheets to be inserted can be carried out with other conveying means which are known per se, such as belts, rolls, rollers, fingers, carriages, slides, etc.

Figure 3:
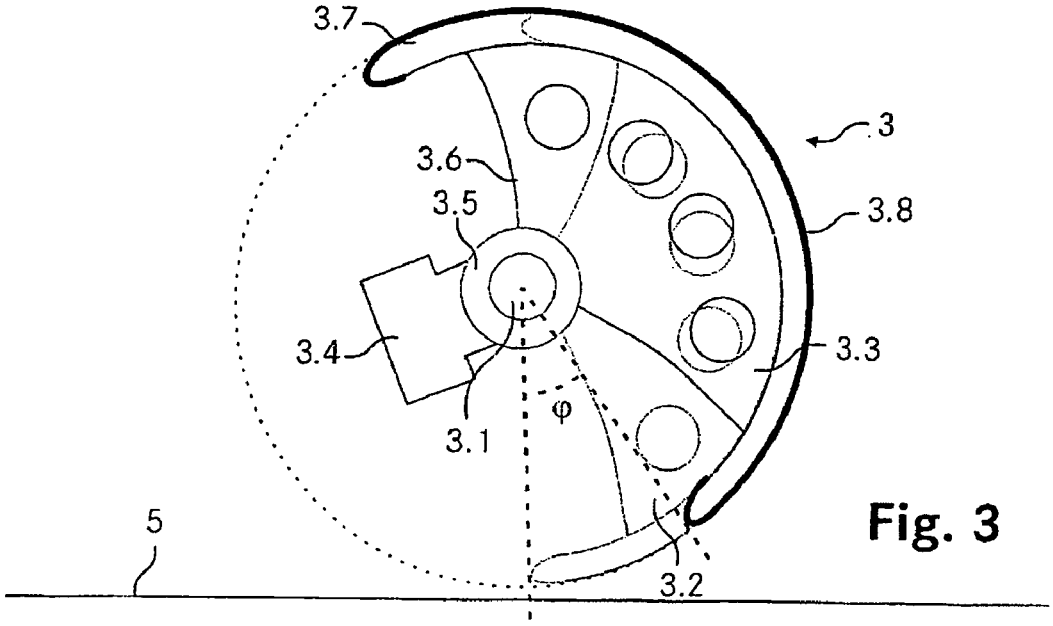
FIG. 3 shows an illustration of a segment roll of the device according to the invention.

FIG. 3 is an illustration of a segment roll of the device according to the invention. The segment roll 3 serves firstly for feeding the empty envelopes, with the already (partially) opened envelope flap being completely opened and the envelope being taken over by the segment roll 3 and conveyed further along a guide plane 5. Secondly, the segment roll also serves for removing the filled envelopes, for example onto a conveyor belt or a lift.

The segment roll 3 comprises a plurality of rolling segments 3.2 and transport segments 3.3, which are arranged along an axle 3.1, and one or more counterweights 3.4 for improving the concentricity of the segment roll 3 by means of better balancing. The rolling and transport segments 3.2, 3.3, respectively, are formed in each case by a ring 3.5 which surrounds the axle 3.1 and on which a respective segment disk 3.6 is arranged. The latter is perforated a number of times in order to reduce weight. Along their circumference, the segment disks 3.6 have a track ring 3.7.

The rolling segment 3.2 (illustrated by dashed lines) is arranged in the center of the axle 3.1 and has a certain phase lead $\phi$ in relation to the transport segments 3.3 arranged on the outside. Its track ring 3.7 has a smooth surface which can slide over the envelope material. By contrast, the track ring 3.7 of the transport segments 3.3 has a rubberized gripping surface 3.8 which avoids slippage between the transport segments 3.3 and the envelope.

If an envelope is therefore brought up with a (partially) opened flap, in a first step through the rolling segment 3.2 mounted upstream the flap is completely opened by the track ring 3.7 pressing the flap flat onto the conveying plane 5. The envelope is not yet moved on here. After further rotation of the segment roll 3 about the phase lead $\phi$, the transport segments 3.3 reach the envelope and convey the latter on account of their gripping surface 3.8 further in the rotational direction along the conveying plane 5. The conveying movement is assisted by a mating roll which has a roller opposite each transport segment 3.3.

As a result of the fact that the segment roll 3 along its circumference has only partial contact with the envelopes, the continuous movement of the roll is converted in a simple manner into a discontinuous conveying movement of the envelopes. This is because a certain distance is to be maintained between two successive envelopes, said distance corresponding to the period of time required for pulling an envelope onto the pocket, filling it and transporting it away again from the pocket. Only then may the front edge of the next envelope leave the convex guide plate at its discharge point and therefore the pulling-on of the next envelope begin.

The arrangement of the individual rolling and transport segments 3.2, 3.3, respectively, may be selected differently. Thus, an individual rolling segment 3.2 for completely opening the envelope flap may be fitted in the center of the segment roll 3 and two transport segments 3.3 for transporting the envelope may be fitted at the edge of the segment roll 3. However, it is also possible only to provide an individual segment 3.3 for transportation or else to provide a larger number of rolling and transport segments 3.2, 3.3 respectively. Instead of individual segments, the segment roll 3 may also be of continuous design.

Furthermore, it is possible for both the opening function and the transport function to be carried out with an individual segment. For this purpose, the segment has a track ring which slides at its front end on the envelope and, after the selected phase lead $\phi$, takes up, for example owing to a different surface or owing to its shape, a frictional connection with the envelope and initiates the transport.

Finally, the imbalance of the segment roll can be further reduced by a larger number of or a different shaping of the counterweights. As a result, the service life of the bearings for the axle of the segment roll can be increased.

Figure 4:
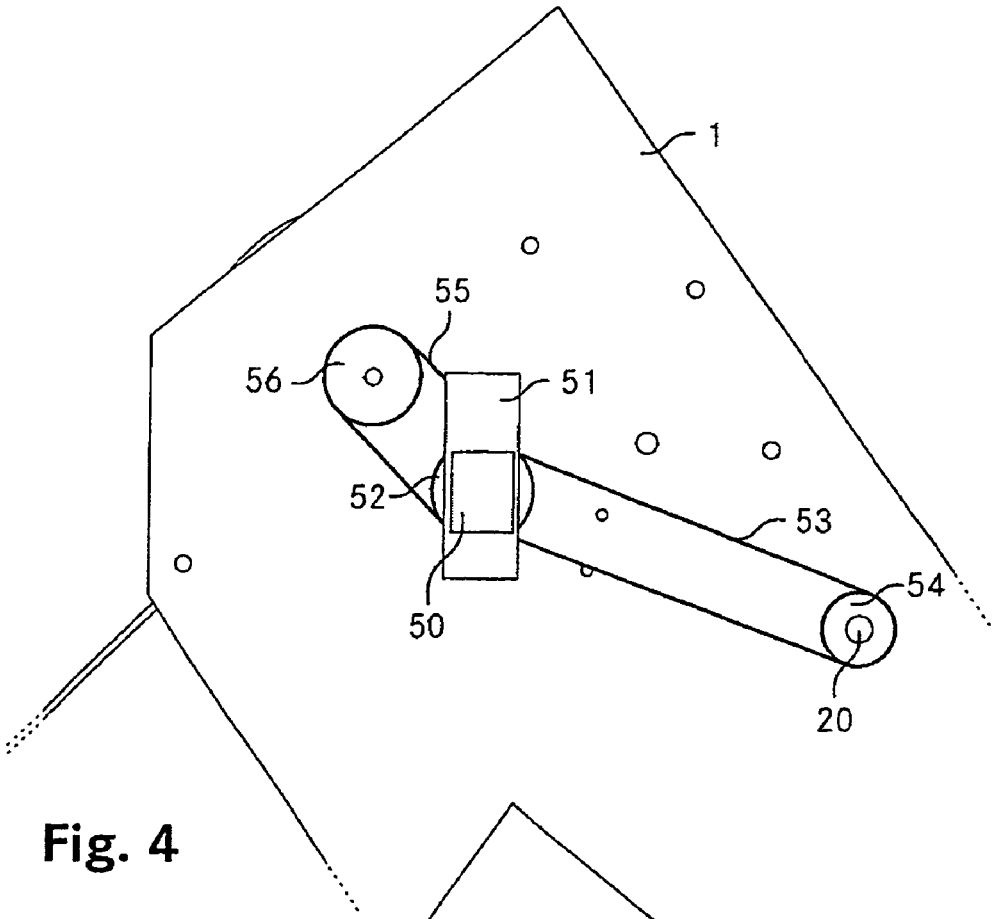
FIG. 4 shows a diagrammatic illustration of the drive of the device according to the invention, on the side of the motor.
Figure 5:
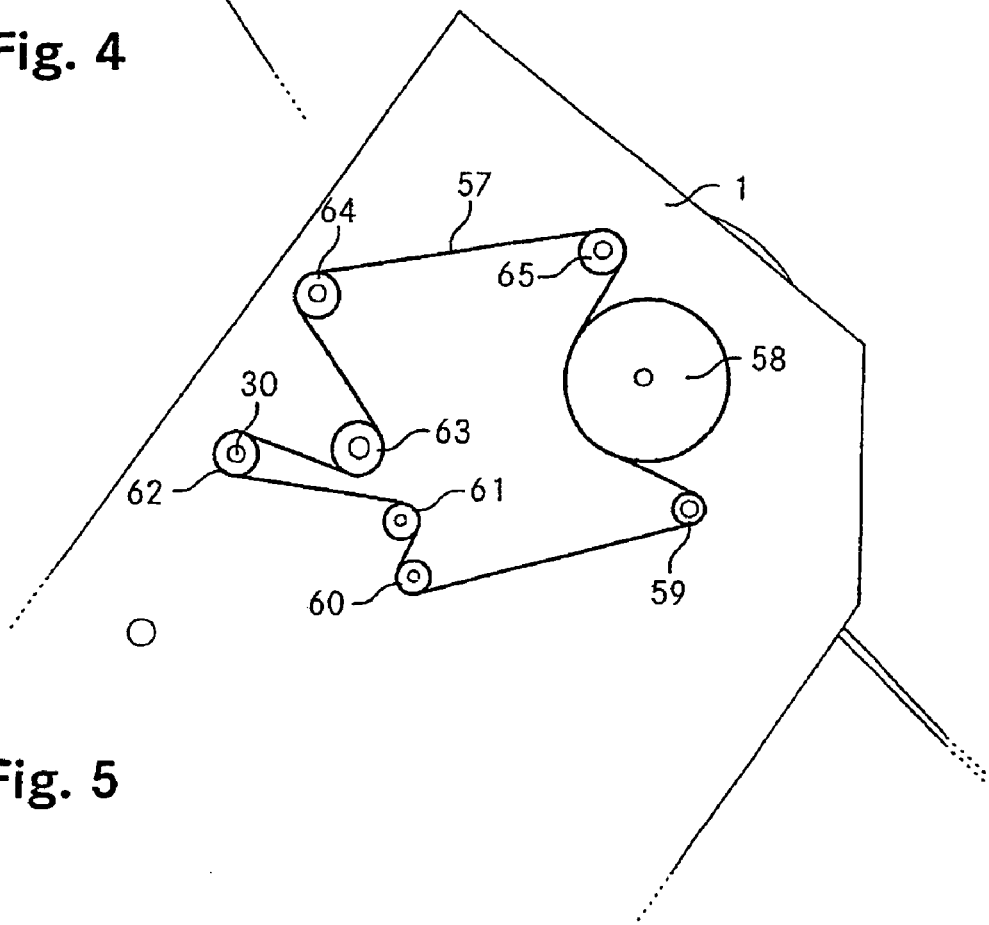
FIG. 5 shows a diagrammatic illustration of the drive on the side opposite the motor.

The device for filling envelopes, including the conveying device for feeding and inserting the sheets, is driven by a single motor. FIG. 4 shows a diagrammatic illustration of the drive of the device according to the invention on the side of the motor; FIG. 5 shows a diagrammatic illustration of the drive on the side opposite the motor.

The motor 50 is fastened to the housing 1 laterally on a support plate 51. It has a pulley 52 via which a first toothed belt 53 interacts with a pulley 54 which is arranged in a rotationally fixed manner on the axle 20 and therefore drives the conveying device 15 for conveying the sheets into the pocket 11. A second toothed belt 55 interacts with the pulley 56 which is arranged in a rotationally fixed manner on the axle which bears the segment roll 3 for bringing up the envelopes.

On that side of the housing 1 which lies opposite the motor 50, the remaining drive axles of the device are driven via a single toothed belt 57, the drive of the toothed belt 57 taking place via a pulley 58 which is connected in a rotationally fixed manner to the axle of the segment roll 3 which is driven by the motor 50 on the opposite side of the device. Following on from this pulley 58 in the clockwise direction are the pulley 59, which is connected in a rotationally fixed manner via an axle to the mating roll 4 for the segment roll 3, the pulley 60, which drives the lower roll 7 for bringing up the envelopes, the pulley 61 for driving the upper roll 8, then the pulley 62 on the axle 30 for driving the uppermost roll 22 via belts, followed by two deflection pulleys 63, 64 and finally a belt tightener 65. Like the segment roll 3, the pulleys 61, 63 rotate in the clockwise direction, the remaining pulleys and deflection pulleys rotate in the counterclockwise direction. The belt tightener 65 is displaceable in a horizontal guide and tensions the toothed belt, for example by means of a spring, in such a manner that it is guided tautly between the pulleys.

The diameters of the pulleys are selected in such a manner and matched to the diameters of the respectively driven rollers that all of the conveying elements of the device for feeding and removing the envelopes and the conveying device for the sheets which are to be inserted are synchronized mechanically with one another.

Instead of a single motor, various axles or groups of axles can be activated individually by motors. In this case, the motors are synchronized with one another, preferably by an electronic controlling means, on the basis of measurements of individual speed and position sensors.

Figure 6:
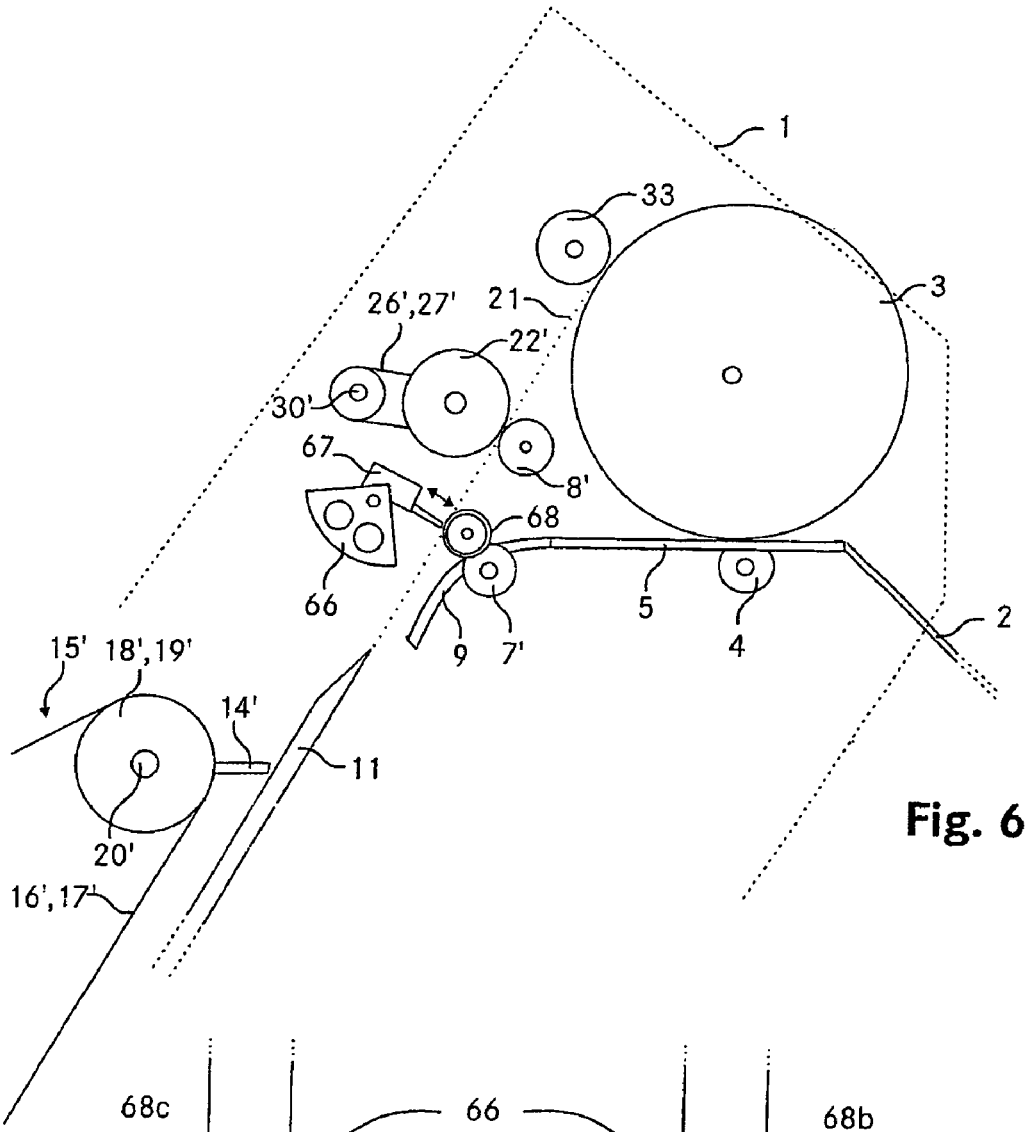
FIG. 6 shows a diagrammatic illustration of a variant of the device according to the invention for inserting sheets into an envelope.

FIG. 6 shows a diagrammatic illustration of a variant of the device according to the invention for inserting sheets into an envelope. It differs from the device illustrated in FIGS. 1-5 by the feed device and the removal device. The conveying distance 15' is somewhat offset back along the pocket 11, but otherwise is constructed in the same manner as the conveying device 15 of the device illustrated further above. The transporting away of the filled envelope from the pocket 11 is assisted by an additional take-off roll 66. The latter is arranged above the plane 21 in which the envelope is transported away and, transversely with respect to the removal direction, along its axle, comprises a plurality of segments arranged parallel with an angle of approx. 90°. The movement of the segments is synchronized with the remaining transport elements in such a manner that the take-off roll 66 grasps the envelope after filling has taken place and conveys it further to the pair of rollers 8', 22', which is displaced upward somewhat along the plane 21 in comparison to the device illustrated further above. In addition to a further increase in the reliability of the device, in particular for thick and heavy envelopes, the take-off roll 66 leads to a relieving of load on the conveying device 15'.

Figure 7:
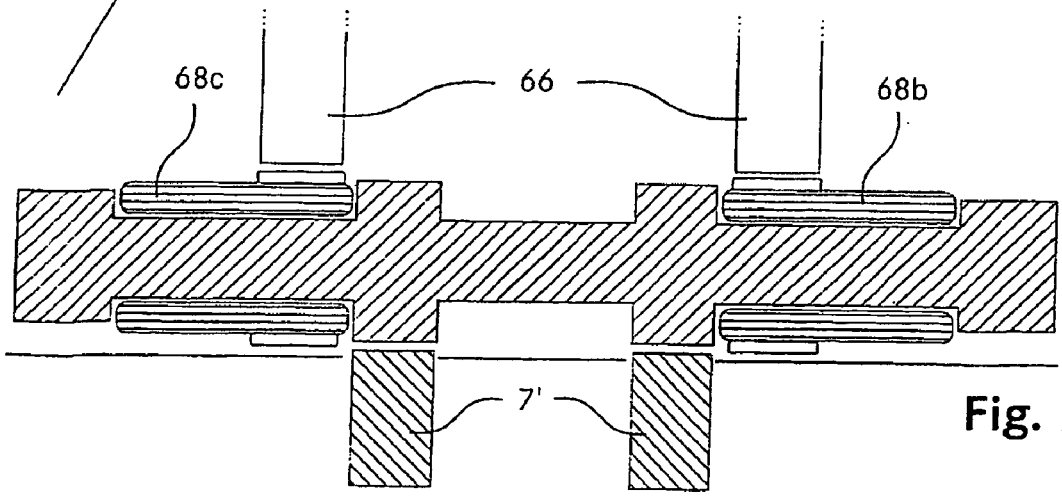
FIG. 7 shows a diagrammatic illustration of a hollow shaft of the variant.

A hollow shaft 68, which comprises an inner shaft 68*a* and outer shaft 68*b*, 68*c* mounted rotatably on the inner shaft 68*a*, interacts with the segment roll 66. The hollow shaft 68 is illustrated diagrammatically in FIG. 7. During the feeding, the envelope is transported between the inner shaft 68*a* and rollers 7' along the guide plate 9 to the pocket 11. During removal of the envelope from the pocket 11, the envelope is transported between the segments of the take-off roll 66 and the outer shafts 68*b*, 68*c* along the plane 21. So that the filled envelope is guided between the segments and the outer shafts 68*b*, 68*c*, the outer shafts 68*b*, 68*c* have an increased diameter in the regions lying opposite the segments. The outer shafts 68*b*, 68*c* are driven independently of the inner shaft 68*a*, for example by different motors. This permits increased flexibility when adapting the device to different tasks to be carried out. The outer shafts 68*b*, 68*c* advantageously have a higher speed than the inner shaft 68*a*. As a result, the transporting away of the filled envelope can be accelerated.

The device additionally comprises an envelope safeguard 67. The latter comprises a barrier which is arranged approximately opposite the hollow shaft 68 and is displaceable into the plane 21 and out of it perpendicularly to the removal direction of the envelopes. It can thus prevent a premature transporting away of the envelope if the latter has not yet been completely filled. The barrier is actuated by means of a lifting magnet and is then moved into the plane 21 when the envelope is pulled onto the pocket and has returned into its original, flat shape. Before the envelope is grasped by the take-off roll 66 for further transport, the lifting magnet is actuated and, as a result, the barrier is moved out of the plane.

The envelope safeguard which prevents the premature transporting away of the envelope can also be provided in the case of the first device according to the invention described further above. Instead of by a lifting magnet, the barrier may also be actuated by other suitable means, such as, for example, a rotary magnet. In addition, the take-off roll can interact with customary rollers or rolls instead of the hollow shaft. The observations with regard to the segment roll for completely opening and feeding the empty envelopes can also largely be transferred to the take-off roll.

Figure 8:
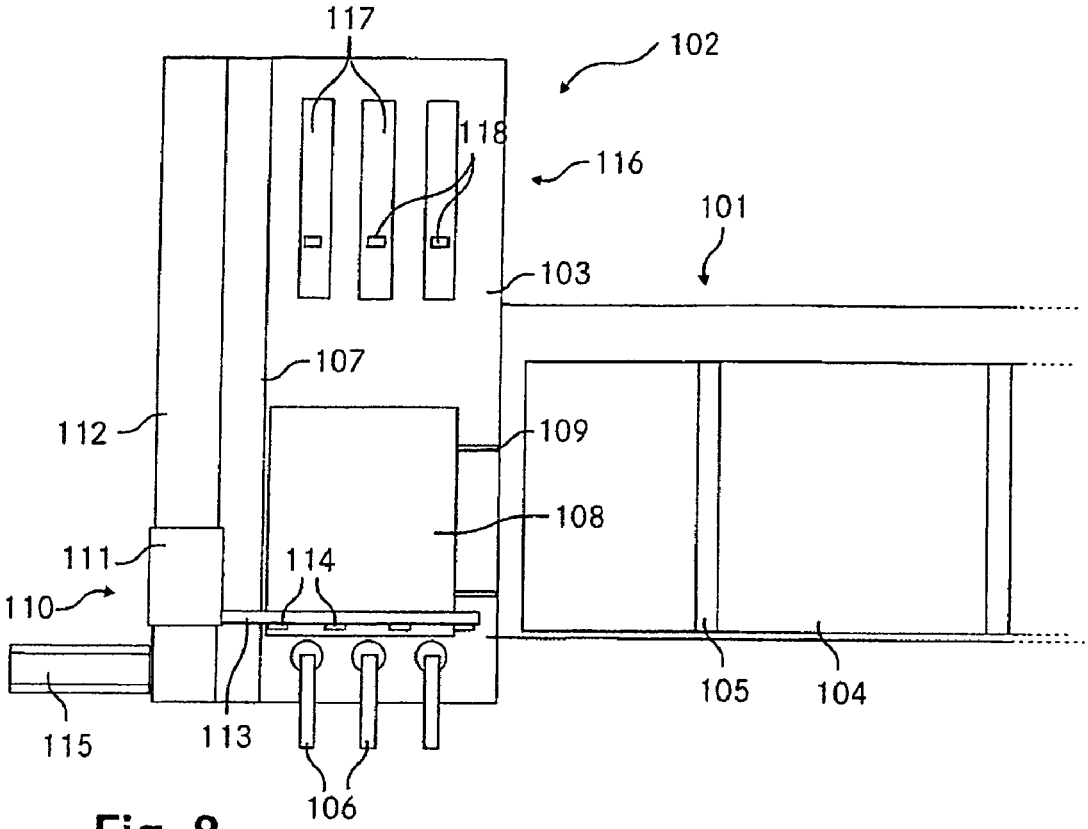
FIG. 8 shows a diagrammatic illustration of a device according to the invention for feeding stacks of envelopes.

FIG. 8 shows a diagrammatic illustration of a device according to the invention for feeding stacks of envelopes. The stacks are supplied horizontally by a conveying device 101 to a lifting device 102. The lifting device 102 lifts the stacks of envelopes along an oblique plane 103, at the upper end of which the envelopes are taken over for further processing, for example by the segment roll of the device for filling envelopes, as illustrated above.

The conveying device 101 is constructed in a manner known per se. The stacks of envelopes are placed onto an oblique plane, the inclination of which corresponds to the oblique plane 103 of the lifting device 102. The oblique plane of the conveying device 101 is designed as conveyor belt 104, with conveying bars 105 being arranged at equal distances transversely with respect to the conveying device. A stack of envelopes is situated in each case between two conveying bars 105, said stack of envelopes being pushed, during movement of the conveyor belt 104, by the conveying bar arranged behind it in the direction of the lifting device 102.

The lifting device 102 comprises, at the lower end of the oblique plane 103, along a line transverse with respect to the oblique plane 103, three sliding rollers 106 which are spaced apart and onto which the stacks of envelopes can be pushed with little friction into the lifting device 102 as far as a stop 107. The stop 107 runs along the entire oblique plane 103 and serves to laterally guide the stacks of envelopes. At its lower end, the lifting device 102 furthermore has a conveying plate 108 with a plasticized surface which can be moved transversely with respect to the oblique plane 103 on rails 109.

Furthermore, the lifting device 102 has two lifts which can be moved along the oblique plane 103. The first lift 110 comprises a carriage 111 which can be moved along on a rail 112 of the entire oblique plane 103. An extension arm 113 is arranged transversely with respect to the conveying direction on the carriage 111. The extension arm 113 has a plurality of prongs 114 in the manner of a comb, directed downward perpendicularly to the oblique plane 103. Said prongs are arranged in such a manner that the first lift 110 can also move behind the line defined by the sliding rollers 106 by the prongs 114 passing precisely into the spacings between the sliding rollers 105. The first lift 110 is driven by a motor 115 which is arranged laterally on the lifting device 102.

The second lift 116 can be moved along an upper region of the oblique plane 103. It is formed by three prongs 118 emerging vertically through slots 117 in the oblique plane 103. Said prongs are connected rigidly to one another below the oblique plane 103, so that all of the prongs 118 are always situated on the same height of the oblique plane 103. The prongs 118 are realized in such a manner that they can be moved between the prongs 114 of the first lift 110. The two lifts 110 and 116 can therefore be moved as desired independently of each other along the upper section of the oblique plane 103. In addition, the second lift 116 can be lowered below the oblique plane 103 and entirely below the oblique plane 103 can be moved from its front into its rear position (and vice versa). In this case, the lift 116 is therefore situated entirely outside the stacking region, i.e. the region in which the stacks of envelopes are moved along the oblique plane 103. The second lift 116 is driven by a further motor (not illustrated) which is arranged below the oblique plane 103.

Figure 9:
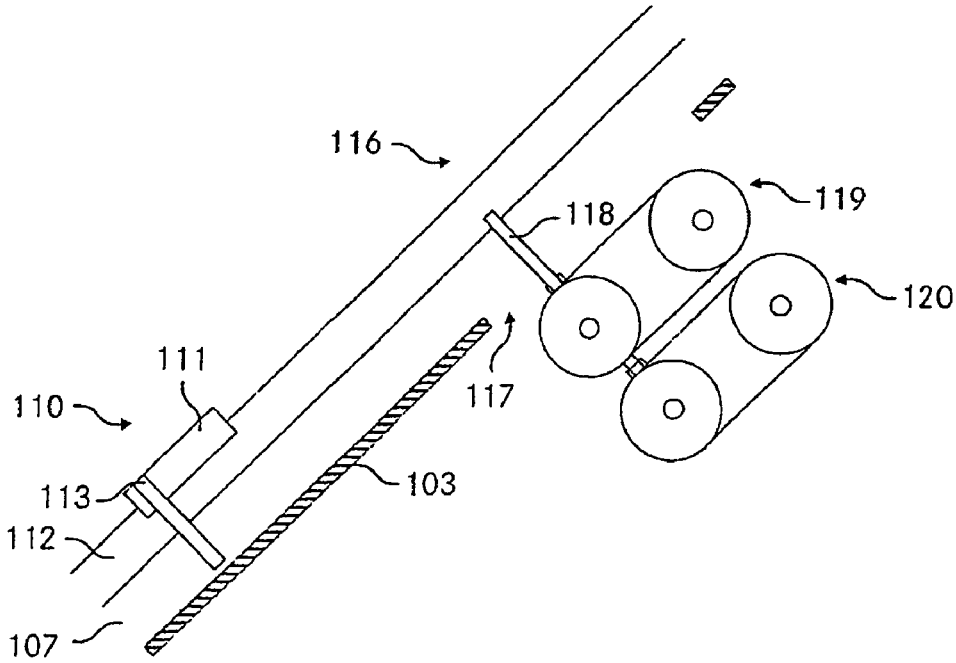
FIG. 9 shows an illustration of the lifts of the device, in side view.

FIG. 9 is an illustration of the lifts of the device in side view. The first lift 110 is mounted moveably on the rail 112 by means of its carriage 111. The stop 107 is arranged between the rail 112 and the stacking region. The first lift 110 engages by means of its extension arm 113 in the stacking region. The second lift 116 engages by means of its prongs 118 in the upper section of the stacking region through slots 117 in the oblique plane 103. The prongs 118 are mounted on two conveyor belts 119, 120, which are arranged below and parallel to the oblique plane 103, and can follow the movements thereof along an essentially oval path. The tips of the prongs 118 can therefore be displaced along an oval path, with the prongs 118 being completely lowered below the oblique plane 103 when the fastening points of the prongs 118 are moved synchronously into the lower section of the conveyor belts 119, 120.

Figure 10:
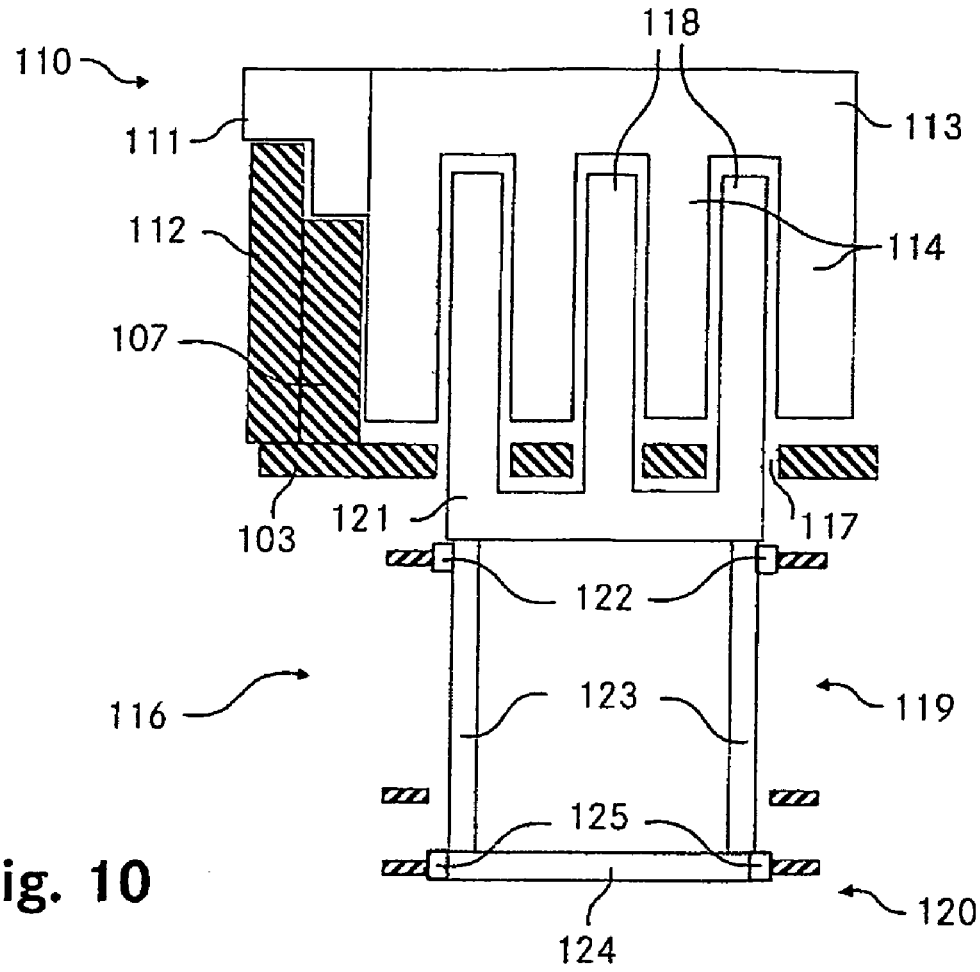
FIG. 10 shows an illustration of the lifts of the device, in front view.

FIG. 10 shows an illustration of the lifts of the device in front view, as seen from the lower end of the oblique plane 103. The lifts take up the same position with regard to the oblique plane 103, i.e. are moved in this same plane. The carriage 111 of the first lift 110 can be moved on the rail 112. Its extension arm 113 has four prongs 114, perpendicularly to the oblique plane 103, which prongs extend to a short distance before the oblique plane 103. The three prongs 118 of the second, lower lift 116 engage in the stacking region through slots 117 in the oblique plane 103 and fill the gaps between the four prongs 114 of the first, upper lift 110 apart from certain safety distances. Below the slots 117, the three prongs 118 of the second lift 116 are connected rigidly to one another by means of a bar 121. The bar 121 is fixed rotatably about its axle on the upper conveyor belt 119 by securing devices 122. Within the individual belts of the upper conveyor belt 119, vertical holding bars 123 are connected rigidly on both sides to the bar 121. Below the upper conveyor belt 119, the holding bars 123 are in turn connected rigidly to one another by a bar 124 for stabilization purposes. The lower bar 124 is fitted rotatably to the lower conveyor belt 120 by means of securing devices 125.

Figure 11:
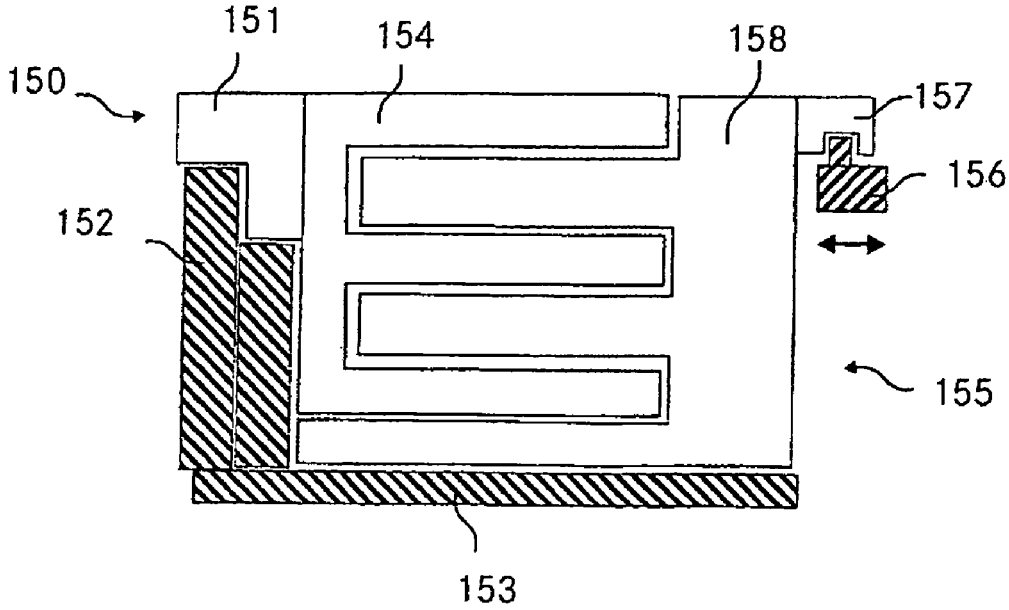
FIG. 11 shows an illustration of an alternative configuration of the lifts.

FIG. 11 shows an illustration of an alternative configuration of two lifts. The first lift 150 in turn comprises a carriage 151 which can be moved along the oblique plane 153 on a first rail 152. An extension arm 154, which is E-shaped and is arranged vertically to the oblique plane 153, is arranged on the carriage 151. The second lift 155 is mounted in a similar manner to the first lift on a second rail 156, which is arranged on the opposite side of the oblique plane 153, and can be moved on it along the oblique plane 153. The second lift 155 also has a carriage 157 and an E-shaped extension arm 158. This extension arm 158 complements the shape of the extension arm 154 of the first lift 150, with the result that both lifts 150, 155 essentially cover the cross section of the stacking region when they are moved into this same plane. The rail 156 of the second lift 155 can be moved together with the second lift 155 laterally out of the stacking region.

The extension arms may also have a different shape, for example may be L-shaped, i.e. comprise in each case two limbs perpendicular to each other. In this case, they are preferably designed in such a manner that the first limb extends along a large part of that side of the stacking region on which the corresponding carriage is arranged. The second limb extends as far as the opposite side of the stacking region. The extension arms are in turn advantageously shaped in such a manner that they cover essentially the entire stacking region when they are moved into this plane.

FIGS. 12A-I serve to diagrammatically illustrate the method steps of a method according to the invention for feeding stacks of envelopes using the described lifting device with two lifts, the second lift reaching up through slots in the oblique plane. However, the method can be carried out in an analogous manner by means of other devices, for example by two lifts having laterally articulated L-shaped extension arms (see FIG. 9) being used.

Figure 12A:
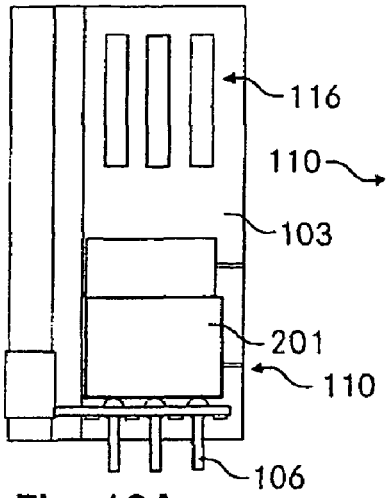
FIG. 12A-I show a diagrammatic illustration of the method steps of a method according to the invention for feeding stacks of envelopes.
Figure 12B:
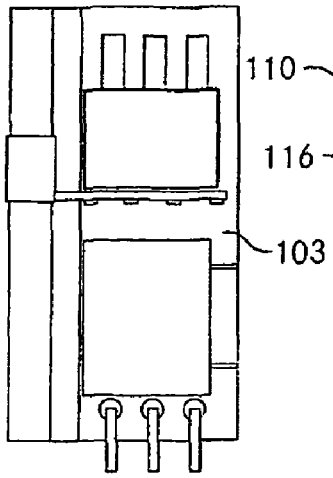
Figure 12C:
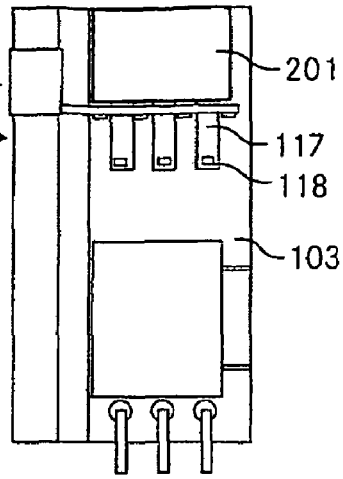
Figure 12D:
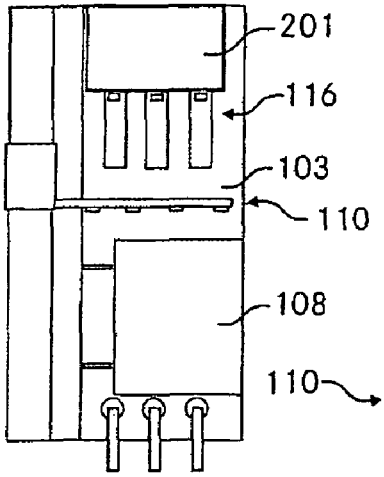
Figure 12E:
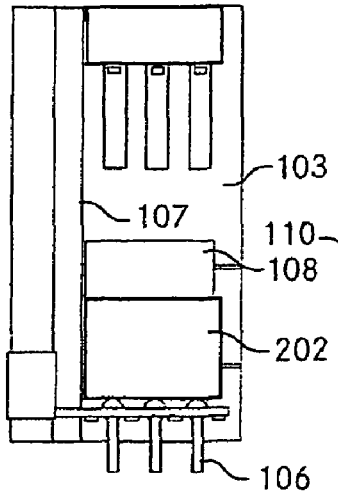
Figure 12F:
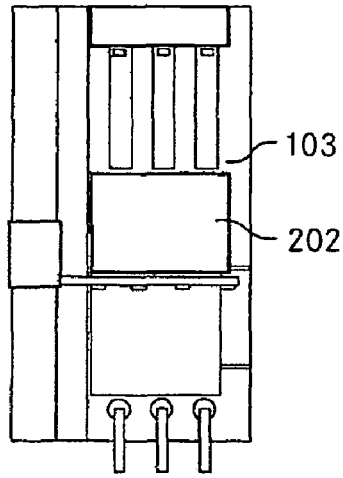

FIG. 12A shows the situation in which a first stack of envelopes 201 has just been transported by the conveying device onto the oblique plane 103 and is now held by the sliding rollers 106. The first lift 110 is situated in its lowermost position, behind the sliding rollers 106. The second lift 116 is lowered below the oblique plane 103, i.e. does not engage in the stacking region.

The first lift 110 is then moved upward along the oblique plane 103. As soon as it passes the line of sliding rollers 106, it grasps the stack of envelopes 201 and transport it upward at the same time. The situation illustrated in FIG. 12B arises. After further lifting of the first lift 110, the upper end of the stack of envelopes 201 reaches the upper edge of the oblique plane 103, whereupon the processing of the envelopes can begin. The uppermost envelope in each case is pulled off from the stack of envelopes 201 and the first lift 110 is moved slowly upward, so that an envelope is always ready for successive processing. The control of the conveying movement of the lift 110 can take place, for example, via a photocell which detects whether an envelope is ready at the upper end of the oblique plane 103. As soon as the first lift 110 with the stack of envelopes 201 has crossed the rear end of the slots 117 in the oblique plane 103, the prongs 118 of the second lift 116 at the rear end of the slots 117 are moved upward, through the oblique plane 103, so that the situation illustrated in FIG. 12C arises.

The second lift 116 is then moved upward along the oblique plane 103 until it lies in one plane with the first lift 110. At this moment, the stack of envelopes 201 is held by both lifts 110, 116. The first lift 110 can now be moved downward along the oblique plane 103. At the same time, the conveying plate 108 is moved into its position adjacent to the device for bringing up new stacks of envelopes, so that the situation shown in FIG. 12D arises. The further conveying of the stack of envelopes 201 upward now takes place by means of the second lift 116.

After the first lift 110 has been moved again behind the sliding rollers 106, the device for bringing up new stacks of envelopes pushes a second stack of envelopes 202 onto the conveying plate 108. As soon as the stack of envelopes 202 is no longer pushed by this device in the direction of the stop 107 of the oblique plane 103, the conveying plate 108 moves in the direction of the stop 107, so that the stack of envelopes is pressed along its entire height against the stop 107. The situation illustrated in FIG. 12E arises.

Figure 12G:
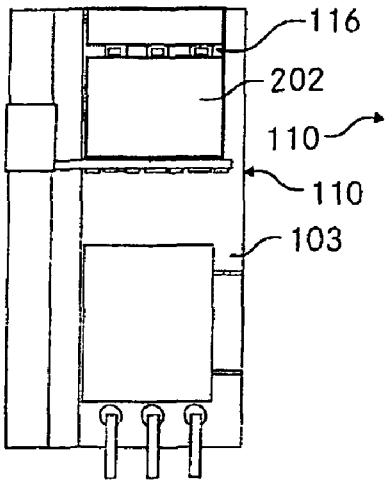
Figure 12H:
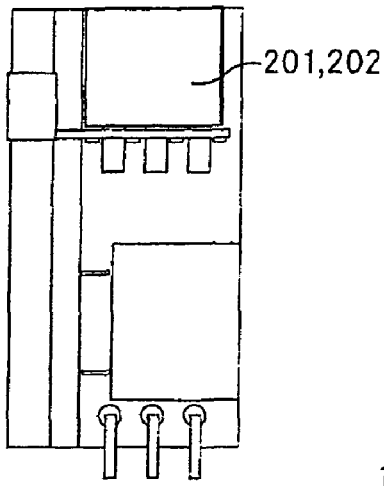

Subsequently, the second stack of envelopes 202 is lifted by the first lift 110 along the oblique plane 103 (FIG. 12F) until the second stack of envelopes 202 adjoins the second lift 116 at the rear (FIG. 12G). As soon as the second lift 116 has reached the upper end of the slots 117, it is lowered below the oblique plane 103 and therefore moved away from the stacking region. As a result, the first stack of envelopes 201 and the second stack of envelopes 202 merge to form a new stack which is held by the first lift 110, as illustrated in FIG. 12H.

Figure 12I:
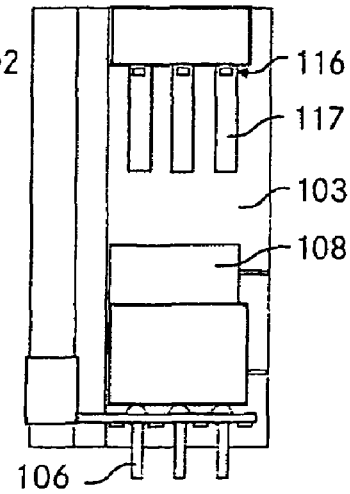

Finally, the second lift 116 is moved below the oblique plane 103 onto the rear end of the slots 117, where it is lifted and moved upward in the stacking region in order to detach the first lift 110. The latter moves in turn entirely back, behind the sliding rollers 106, and, with the aid of the conveying plate 108, a stack of envelopes 203 is once again picked up by the device. This situation is illustrated in FIG. 12I and corresponds to the state of the method in FIG. 12E. The lifting device according to the invention therefore permits a continuous feeding of stacks of envelopes. There are no interruptions whatsoever between two successive stacks, and the feeding takes place fully automatically.

Figure 13:
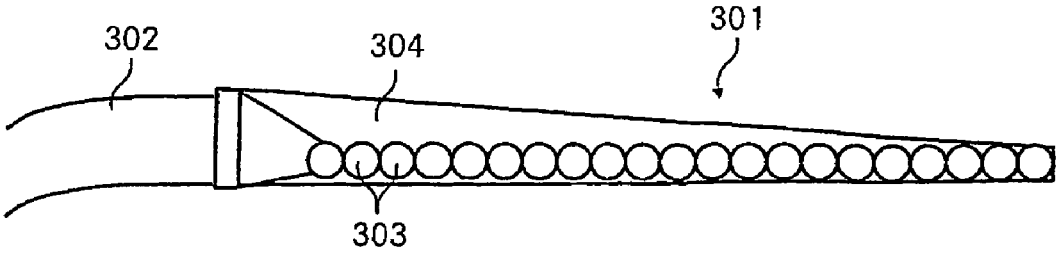
FIG. 13 shows an illustration of a device according to the invention for opening an envelope flap, in front view.
Figure 14:
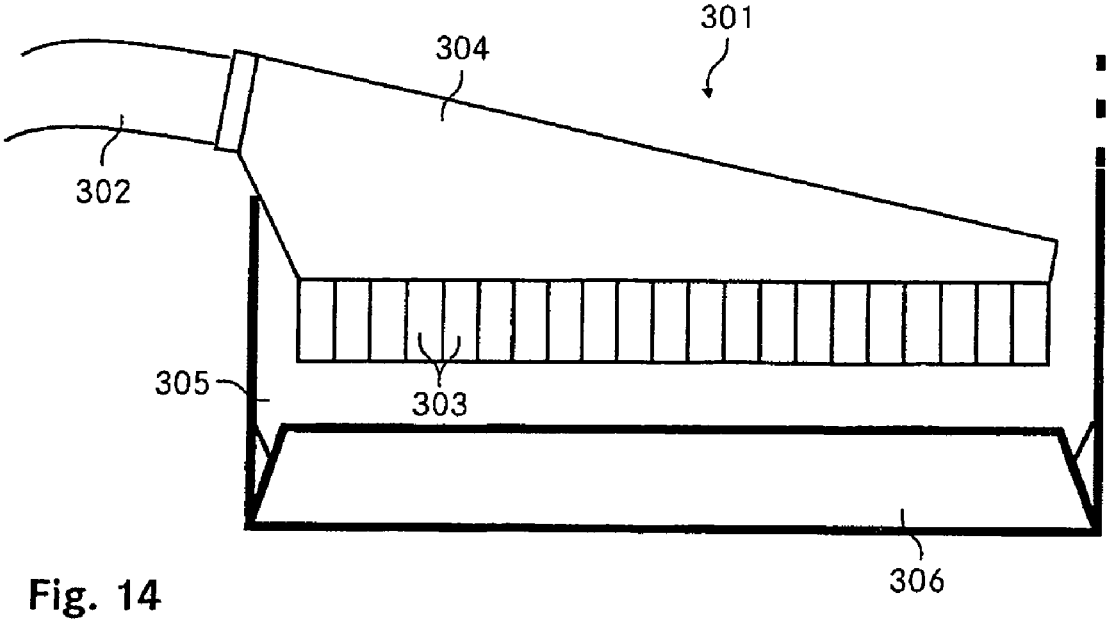
FIG. 14 shows an illustration of the device in plan view with its arrangement relative to the envelope to be opened.
Figure 15:
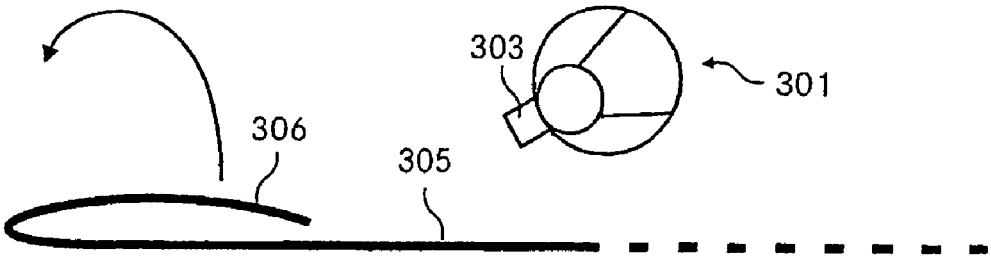
FIG. 15 shows an illustration of the device in lateral view with its arrangement relative to the envelope to be opened.

FIGS. 13-15 show an illustration of a device according to the invention for opening an envelope flap. This device is suitable in particular for use with the above-illustrated device for filling envelopes. In this case, it is arranged directly in front of the segment roll which fully presses open the envelope flap which has already been opened.

FIG. 13 shows a view of the blowing unit of the device in front view. The blowing unit 301 is supplied via a tube 302 with compressed air generated by a source which is known per se. The blowing unit 301 comprises a row of individual nozzles 303 with a round cross section which are arranged directly adjacent to one another. In order to reach a uniform distribution of pressure, the volume of the preliminary nozzle space 304 is reduced with increasing distance from the supply of compressed air.

FIGS. 14 and 15 show the blowing unit 301 in plan view and lateral view, and the arrangement thereof with respect to an envelope 305 to be opened. The row of nozzles 303 is arranged parallel to the envelope flap 306 which is to be opened. The length of the row of nozzles corresponds approximately to the extent of the envelope flap 306. The nozzles 303 are slightly inclined with respect to the envelope plane, so that the compressed air output can be blown under the flap 306 and the latter is pressed open. The vertical distance of the blowing unit 301 from the envelope 305 is advantageously selected to be as small as possible, i.e. such that the envelope 305 can still just be fed through under the blowing unit 301. As a result, the loss of pressure between the nozzles 303 and the envelope flap 306 can be minimized. At the same time, the compressed air still exerts a significant force on the envelope flap 306 even if the latter is already virtually completely bent over.

A segment roll, as illustrated above, advantageously directly adjoins the device for opening the envelope flap. Said segment roll uses the first segment to grasp the partially opened envelope flap and to fully press it open before the further segments initiate the advancing of the envelope.

It is to be stated in summary that the invention provides a device for inserting sheets into an envelope, which device permits an increased capacity and has a simpler mechanical construction.

The invention claimed is:

1. A device for inserting sheets into an envelope, comprising:

a holding device having a main surface for supporting the envelope during insertion of the sheets into the envelope;

transport members for feeding the sheets to be inserted to the holding device;

a feed device for feeding the envelope to the holding device along a feed direction; and a removal device for removing the filled envelope from the holding device along a removal direction; wherein the main surface of the holding device has a fixed orientation relative to the feed device and to the removal device and maintains the same fixed orientation during feeding and removing of the envelope respectively in the feed and removal directions, the feed device and the removal device being arranged relative to the main surface of the holding device to define a first angle between the feed direction and the main surface of the holding device and a second angle between the removal direction and the main surface of the holding device, the first and second angles being different from each other.

2. The device as claimed in claim 1, wherein the removal device is arranged relative to the holding device in such a manner that the main surface of the holding device is permanently parallel to the removal direction.

3. The device as claimed in claim 2, wherein the feed device comprises a guide element with a discharge point, the guide element being convex at its discharge point.

4. The device as claimed in claim 3, wherein the guide element is formed by a curved guide plate with a vacuum device.

5. The device as claimed in claim 1, wherein the holding device is formed by a pocket onto which the envelope can be pulled.

6. The device as claimed in claim 1, wherein the removal device comprises a first conveying device with a first, lower pressing roll and a second, upper pressing roll, the second pressing roll being pressed resiliently against the first pressing roll.

7. The device as claimed in claim 6, wherein the feed device is arranged below the removal device, and in that the feed device comprises a second conveying device with an upper pressing roll and a lower pressing roll, the first pressing roll of the first conveying device at the same time forming the upper pressing roll of the second conveying device.

8. The device as claimed in claim 1, further comprising a safeguard for the envelope, for preventing a premature removal of the envelope from the holding device.

9. The device as claimed in claim 1, wherein the removal device comprises a take-off roll with a segment for grasping the filled envelope which is to be removed.

10. The device as claimed in claim 1, wherein all of the transport elements for the envelopes are driven by a single motor.

11. The device as claimed in claim 1, wherein the feed device has a segment roll for pulling the envelope off from a stack, with a rolling segment for fully pressing open a flap of the envelope, and a transport segment for transporting the envelope.

12. The device as claimed in claim 11, wherein the segment roll is designed in such a manner that a first coefficient of friction of a surface of the rolling segment is smaller than a second coefficient of friction of a surface of the transport segment.

13. The device as claimed in claim 12, wherein the rolling segment and the transport segment are formed by claws which are arranged on a common rotational axle.

14. The device as claimed in claim 11, wherein the rolling segment and the transport segment are formed by claws which are arranged on a common rotational axle.

15. The device as claimed in claim 1, wherein the transport members are configured to feed the sheets in a sheet transport direction parallel to the main surface of the holding device.

16. The device as claimed in claim 1, wherein the transport members are configured to push the filled envelope in the removal direction by acting on the sheets.

17. The device of claim 1, wherein the holding device is non-pivoting.

* * * * *

UNITED STATES PATENT AND TRADEMARK OFFICE

CERTIFICATE OF CORRECTION

PATENT NO. : 7,788,880 B2
APPLICATION NO. : 10/553969
DATED : September 7, 2010
INVENTOR(S) : Peter Kern It is certified that error appears in the above-identified patent and that said Letters Patent is hereby corrected as shown below:

At column 7, line 11, change “FIG. 12A-I” to --FIGS. 12A-I--.

At column 13, line 30, change “perpendicularly” to --perpendicular--.

At column 14, line 23, change “transport” to --transports--.

Signed and Sealed this
Fifteenth Day of March, 2011

David J. Kappos

David J. Kappos
*Director of the United States Patent and Trademark Office*